US010562730B2

(12) United States Patent
Ito

(10) Patent No.: US 10,562,730 B2
(45) Date of Patent: Feb. 18, 2020

(54) IMAGE RECORDING APPARATUS

(71) Applicant: Brother Kogyo Kabushiki Kaisha, Nagoya-shi, Aichi-ken (JP)

(72) Inventor: Tsuyoshi Ito, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 19 days.

(21) Appl. No.: 15/003,853

(22) Filed: Jan. 22, 2016

(65) Prior Publication Data

US 2016/0214408 A1 Jul. 28, 2016

(30) Foreign Application Priority Data

Jan. 23, 2015 (JP) ..... 2015-011844

(51) Int. Cl.
*B65H 29/70* (2006.01)
*B65H 29/12* (2006.01)
*B65H 29/52* (2006.01)

(52) U.S. Cl.
CPC ..... *B65H 29/70* (2013.01); *B65H 29/12* (2013.01); *B65H 29/52* (2013.01); *B65H 2301/5122* (2013.01); *B65H 2301/51214* (2013.01); *B65H 2404/1115* (2013.01); *B65H 2404/611* (2013.01); *B65H 2801/06* (2013.01)

(58) Field of Classification Search
None
See application file for complete search history.

(56) References Cited

U.S. PATENT DOCUMENTS 5,805,176 A * 9/1998 Saito ..... B41J 11/005 347/104
6,655,864 B2 * 12/2003 Saito ..... B41J 11/005 271/188
2003/0048345 A1 * 3/2003 Matsumoto ..... B41J 11/005 347/104

(Continued)

FOREIGN PATENT DOCUMENTS

JP H08-267856 A 10/1996
JP 2003-176071 A 6/2003
JP 2014-166743 A 9/2014

OTHER PUBLICATIONS

Apr. 10, 2018—(JP) Notice of Reasons for Rejection—App 2015-011844.

*Primary Examiner* — Alejandro Valencia
(74) *Attorney, Agent, or Firm* — Banner & Witcoff, Ltd.

(57) ABSTRACT

An image recording apparatus includes: a recording unit configured to record an image on a sheet conveyed in a conveyance direction; conveyance rollers arranged downstream of the recording unit in the conveyance direction to be apart from each other in a width direction orthogonal to the conveyance direction; first spur rollers arranged oppositely to the conveyance rollers respectively and configured to nip the sheet between the conveyance rollers and the first spur rollers; second spur rollers arranged between the mutually adjoining first spur rollers respectively in the width direction; and a first guide member arranged upstream of the first spur rollers and the second spur rollers in the conveyance direction; and having a first guide surface configured to guide the sheet to a nip position at which the sheet is nipped by the conveyance rollers and the first spur rollers.

11 Claims, 10 Drawing Sheets

(56) References Cited

U.S. PATENT DOCUMENTS

| | | | | |
|---|---|---|---|---|
| 2006/0268292 | A1* | 11/2006 | Takeuchi | B41J 23/025 358/1.8 |
| 2013/0135409 | A1 | 5/2013 | Ito et al. | |
| 2014/0146118 | A1* | 5/2014 | Ito | B41J 11/006 347/104 |

* cited by examiner

IMAGE RECORDING APPARATUS

CROSS REFERENCE TO RELATED APPLICATION

The present application claims priority from Japanese Patent Application No. 2015-011844 filed on Jan. 23, 2015, the disclosures of which is incorporated herein by reference in its entirety.

BACKGROUND

Field of the Invention

The present invention relates to an image recording apparatus which is capable of allowing a sheet, on which an image is to be recorded in a recording section, to be in a wavy shape.

Description of the Related Art

In an ink-jet recording apparatus that records an image by jetting ink droplets on to a sheet such a recording paper supported on a platen, through nozzles provided in a recording unit, sometimes a phenomenon (cockling) in which, a part of the sheet having an ink adhered thereto is lifted off due to swelling, occurs. As the cockling occurs, due to the part of the sheet lifted off the platen thereby making a contact with the recording section or making a contact with a guide member that guides the sheet, there is a possibility that an image recorded on the sheet is distorted or that there is a jamming of paper.

Therefore, an arrangement by which, it is possible to suppress the occurrence of cockling by providing a plurality of paper discharge rollers, and a plurality of first spur rollers, and a plurality of second spur rollers downstream in the conveyance direction, of the platen has been known. Concretely, the plurality of paper discharge rollers is arranged at intervals between the two adjacent paper discharge rollers, along a direction of width which is orthogonal to a conveyance direction, and makes a contact with a reverse surface of a surface of the sheet on which the image has been recorded. The plurality of first spur rollers is provided face-to-face at an upper side of the plurality of paper discharge rollers respectively, and the sheet is pinched between the mutually facing first spur rollers and the paper discharge rollers, and conveyed. The plurality of second spur rollers is arranged between the adjacent first spur rollers in the direction of width, and a position of the lowermost end is lower than the uppermost end of the paper discharge roller.

Each of the plurality of second spur rollers abuts against the surface having an image recorded of the sheet that is conveyed from the platen, and pushes down an abutting portion below the uppermost end of the paper discharge roller. Accordingly, the sheet becomes wavy along the direction of width. In such wavy state, even when an ink is adhered to the sheet supported on the platen and a part of the sheet is swollen, it is possible to suppress an occurrence of the phenomenon (cockling) in which the sheet is lifted off the platen.

SUMMARY

However, in the aforementioned arrangement, since the second spur roller is provided to the downstream in the conveyance direction of the first spur roller, the second spur roller, after the sheet is pinched between the paper discharge roller and the first spur roller which are adjacent in the direction of width, pushes down the sheet to a lower side (below) the uppermost end of the paper discharge roller, between the respective pinching positions. In this case, for instance, when the sheet is flat without being caved in (dented) between the pinching positions which are adjacent in the direction of width, it is difficult to make that flat location to be caved in to form a recess. Therefore, there is a possibility that the sheet cannot be made to have a wavy shape in the direction of width.

Moreover, unlike the aforementioned arrangement, in a case in which, the second spur roller is provided to the upstream of the first spur roller, for making the sheet to be dented to form a recess, the lowermost end of the second spur roller is to be arranged at a lower side of the pinching position between the first spur roller and the paper discharge roller. Depending on an angle of entry of the sheet to the second spur roller, a substantial load is exerted to the sheet that has abutted against the second spur roller, thereby damaging a part of the sheet, which in turn, leads to jamming of sheet.

The present teaching has been made in view of the abovementioned circumstances, and an object of the present teaching is to provide an image recording apparatus which is capable of allowing a sheet; on which an image is to be recorded in a recording section, to be in a wavy shape easily, along a width direction which is orthogonal to the conveyance direction.

According to an aspect of the present teaching, there is provided an image recording apparatus including: a recording unit configured to record an image on a sheet conveyed in a conveyance direction; conveyance rollers arranged downstream of the recording unit in the conveyance direction to be apart from each other in a width direction orthogonal to the conveyance direction; first spur rollers arranged opposingly to the conveyance rollers respectively and configured to nip the sheet between the conveyance rollers and the first spur rollers; second spur rollers arranged between the mutually adjoining first spur rollers respectively in the width direction; and a first guide member arranged upstream of the first spur rollers and the second spur rollers in the conveyance direction, and having a first guide surface configured to guide the sheet to a nip position at which the sheet is nipped by the conveyance rollers and the first spur rollers, wherein, as viewed in the width direction; the second spur rollers overlaps with the nip position, and as viewed in the width direction, a circular virtual outer circumferential line along an outer circumference of each of the second spur rollers does not overlap with a virtual straight line along the first guide surface.

According to such arrangement, the sheet that is guided by the first guide surface of the first guide member abuts against the second spur rollers before reaching the nip position or at the same time as when nipped. Accordingly, it is possible to allow easily the sheet to be in a caved-in state in the form of a recess by the second spur rollers. Moreover, for the sheet that is guided by the first guide surface, since the angle of entry to (angle of contact with) the second spur rollers is regulated, there is no possibility that a substantial load is exerted to the sheet when the sheet abuts against the second spur rollers. Accordingly, damage to the sheet or occurrence of jamming of sheet at the second spur rollers is suppressed. Moreover, since each of the second spur rollers overlaps with the nip position as viewed in the width direction, it is possible to allow the sheet to be in the wavy shape effectively.

DESCRIPTION OF THE EMBODIMENTS

An explanation will be made below about an embodiment of the present teaching appropriately with reference to the drawings. The embodiment described below is only an example of the present teaching, and it is needless to mention that the embodiment of the present teaching can be changed appropriately without departing from the scope of the present teaching. In the following explanation, the up-down direction 7, the front-rear direction 8, and the width direction (left-right direction) 9 are defined on the basis of the state of FIG. 1 in which a multifunction peripheral 10 is installed usably.

<Overall Structure of Multifunction Peripheral>

Figure 1:
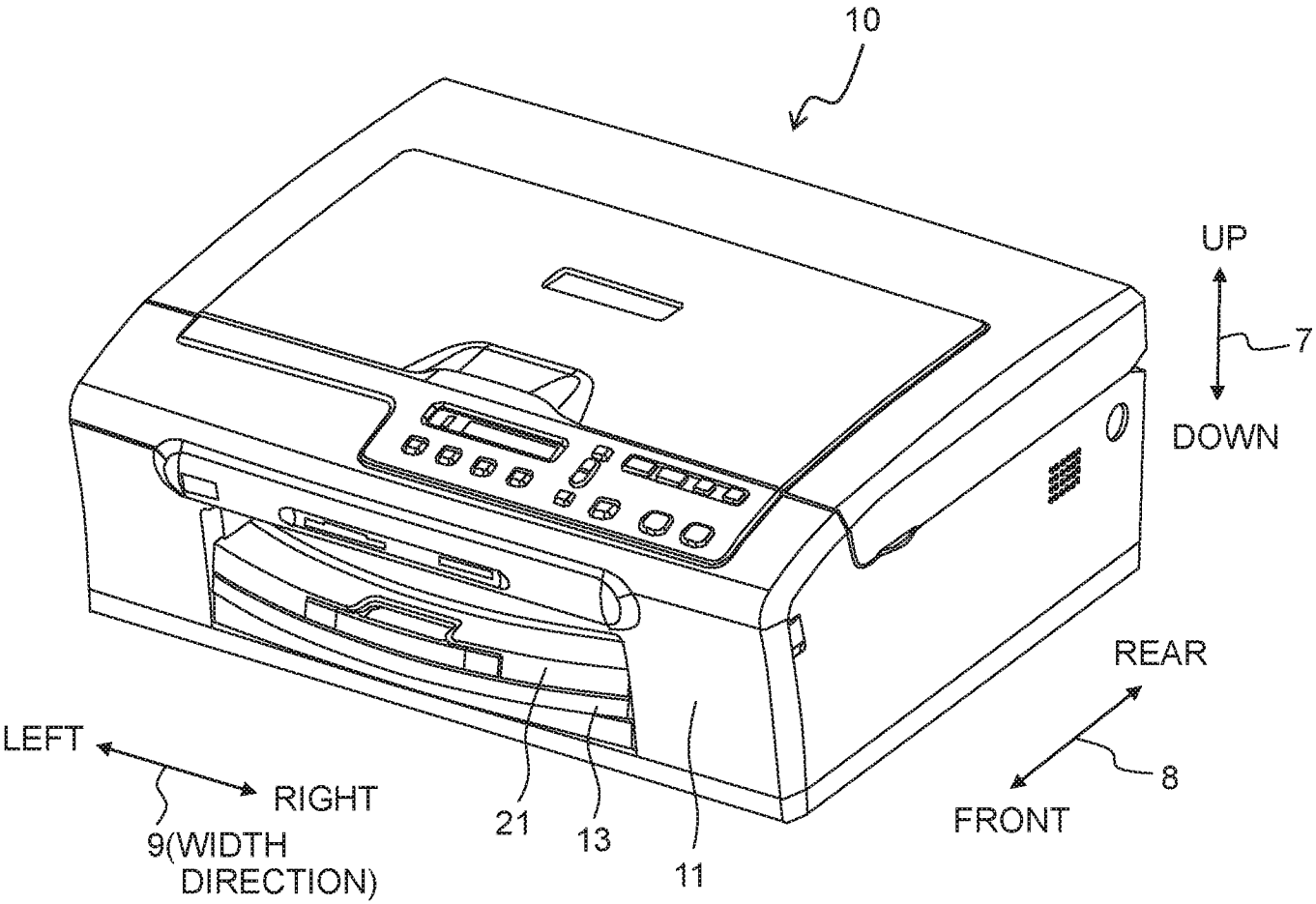
FIG. 1 is a perspective view illustrating a multifunction peripheral as an example of an embodiment of the present teaching.

The multifunction peripheral 10 (an example of an image recording apparatus of the present teaching) has various functions such as a printer function, a facsimile function, and a copy function. The multifunction peripheral 10 includes an apparatus main-body 11 which is arranged to have a substantially thin rectangular parallelepiped shape and a feeding tray 13 which is detachable from a lower portion of the apparatus main-body 11. The feeding tray 13, as shown in FIG. 1, from a state of being installed on the apparatus main-body 11, is uninstalled from the apparatus main-body 11 by being drawn out frontward from the apparatus main-body 11.

Figure 2:
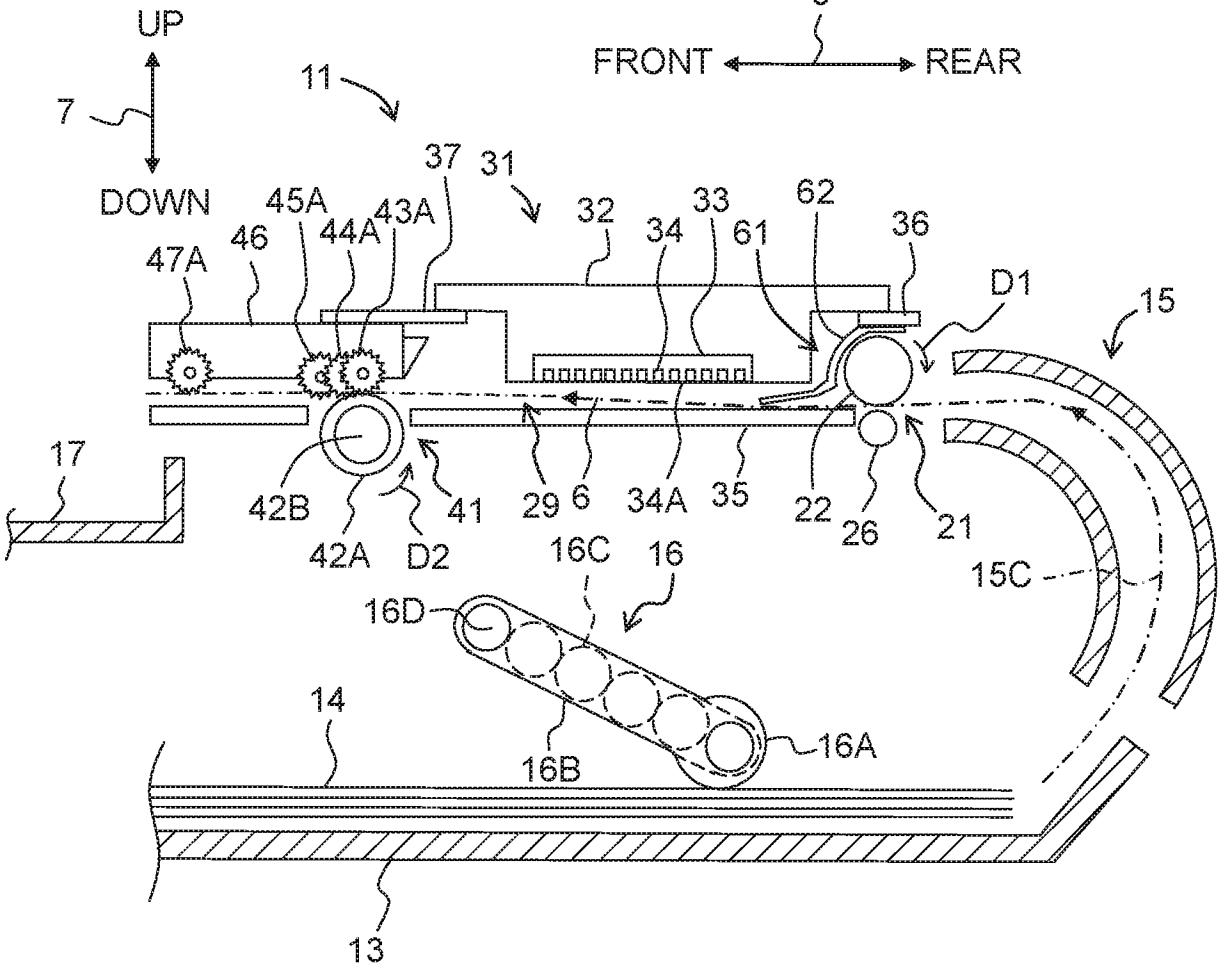
FIG. 2 is a schematic view illustrating a structure of the multifunction peripheral.

As shown in FIG. 2, a recording section 31 which records an image on a recording medium is provided to an upper portion inside the apparatus main-body 11. The feeding tray 13 installed on the apparatus main-body 11 is positioned at a lower side of the recording section 31, and a plurality of sheets (recording media) on which an image is to be formed in the recording section, may be accommodated in a state of being stacked vertically in the feeding tray 13. In the present embodiment, a recording paper 14 which is an ordinary paper of a size A4 is accommodated as a sheet inside the feeding tray 13 with a longitudinal direction of the recording paper 14 along the frontward-rearward direction 8.

An interior of the apparatus main-body 11 is provided with a feeding section 16 which conveys rearward the recording paper 14 at the top of the recording papers 14 accommodated inside the feeding tray 13, and a feeding guide member 15 which guides upward the recording paper 14 that is conveyed rearward from the feeding tray 13. The feeding guide member 15 is arranged at a position close to area/surface inside the apparatus main-body 11.

The feeding section 16 includes a feeding roller 16A that is arranged along the width direction 9, and a supporting arm 16B that supports the feeding roller 16A to be movable in the vertical direction 7. The supporting, arm 16B is pivotably supported by a supporting shaft 16D along the width direction 9, and the feeding roller 16A is rotatably supported by a front-end portion of the supporting arm 16B. The feeding roller 16A, by the supporting, arm 16B being pivoted in the vertical direction 7 with the supporting shaft 16D as a center, moves to a position of abutting with the recording paper 14 at the top of the recording papers 14 accommodated inside the feeding tray 13, and to a position of being separated apart upward from the recording paper 14. The feeding roller 16A is rotated by a driving force of a motor not shown in the diagram, being transmitted by a driving-force transmission mechanism 16C.

As the feeding roller 16A rotates in a state of being abut with the recording paper 14 at the top of the recording papers 14 accommodated inside the feeding tray 13, the recording paper 14 at the top is fed in the rearward direction. The recording paper 14 fed from the feeding tray 13 is conveyed to a lower-end portion of the feeding guide member 15.

The feeding guide member 15 is provided with a feeding path 15C through which the recording paper 14 passes. The feeding path 15C has a circular arc shape projected toward the rear surface of the apparatus main-body 11, and the recording paper 14 which is guided by the feeding guide member 15 is conveyed frontward from an upper-end portion of the feeding guide member 15.

The recording paper 14 in the feeding tray 13 is conveyed in a state of a central portion in the width direction 9 of the recording, paper 14 along a central portion in the width direction 9 of the feeding path 15C (center reference). Moreover, the multifunction peripheral 10 is capable of feeding not only the recording paper 14 of size A4 but also a recording paper of a size smaller than A4, such as a postcard (having a higher rigidity than an ordinary paper), to the feeding path 15C with center reference.

At a front-side position close to the upper-end portion of the feeding guide member 15, a pair of conveyance rollers 21 that conveys the recording paper 14 passed the upper-end portion of the feeling guide member 15 to a lower side of the recording section 31, is provided. A platen 35 which supports the recording paper 14 at a lower side of the recording section 31 is provided at a front side of the pair of conveyance rollers 21, or in other words, downstream in the conveyance direction of the recording paper 14 by the pair of conveyance rollers 21 (hereinafter, let to be "sheet conveying direction 6" (refer to FIG. 2)). An upstream wavy shape applying mechanism 61 and a downstream wavy shape applying mechanism 41 which impart a wavy shape in the width direction 9 to the recording paper 14 are provided to an upstream and to a downstream respectively in the sheet conveying direction 6 of the platen 35.

The pair of conveyance rollers 21 conveys the recording paper 14 passed through the feeding guide member 15, to a conveying path 29 formed between the platen 35 and the recording section 31. The conveying path 29 reaches up to a paper discharge tray 17 via the downstream wavy shape applying mechanism 41.

The pair of conveyance rollers 21 includes one first conveyance roller 22 which abuts against an upper surface (first surface) of the recording paper 14 passed through the feeding guide member 15, and a plurality of pinch rollers 26 which abuts against a lower surface (second surface) of the recording paper 14. The recording paper 14 that has passed through the feeding guide member 15 is pinched between the pinch roller 26 and the first conveyance roller a rotating state, and is conveyed on the platen 35.

The recording section 31 provided at an upper side of the platen 35 is supported by a first guide rail 36 and a second guide rail 37, each arranged along the width direction 9. The first guide rail 36 and the second guide rail 37 are extended along the width direction 9 in a state of being separated apart leaving a fixed interval (distance) in the sheet conveying direction 6.

The recording section 31 includes a carriage 32 which is slidably supported across the first guide rail 36 and the second guide rail 37, and a recording head 33 which is installed at a lower portion of the carriage 32. The carriage 32 is reciprocatable along the width direction 9 along the first guide rail 36 and the second guide rail 37.

The recording head 33 includes a plurality of nozzles 34 that jets an ink in a downward direction. An ink from an ink cartridge (not depicted in the diagram) is supplied to each nozzle 34. The plurality of nozzles 34 is arranged in a row along the sheet conveying direction 6, and a lower end of each nozzle 34 opens through a nozzle surface 34A which is a lower surface of the recording head 33. The nozzle surface 34A is a flat surface along the frontward-rearward direction 8 and the width direction 9.

The platen 35 provided at the lower side of the recording section 31 supports the recording paper 14 conveyed by the pair of conveyance rollers 21, in a state parallel to the nozzle surface 34A.

As the recording paper 14 conveyed by the pair of conveyance rollers 21 reaches a predetermined position on the platen 35, conveyance of the recording paper 14 is stopped, in such state, the carriage 32 slides in the width direction 9 orthogonal to the sheet conveying direction 6, and while the carriage 32 slides, a recording process in which, inks are jetted selectively from the nozzles 34 of the recording head 33, is carried out. Thereafter, by a conveyance process, in which the recording paper 14 on the platen 35 is conveyed by only a predetermined distance by the pair of conveyance rollers 21 and a recording process by the recording head 33 being carried out repeatedly, an image is recorded on the overall recording paper 14.

The downstream wavy shape applying mechanism 41 provided downstream in the sheet conveying direction 6 with respect to the platen 35 conveys the recording paper 14 supported on the platen 35 in the sheet conveying direction 6, and also imparts a wavy shape along the width direction 9 to the recording paper 14 on the platen 35. The recording paper 14 that has passed through the downstream wavy shape applying mechanism 41 is discharged to the paper discharge tray 17.

<Pair of Conveyance Rollers>

Figure 3:
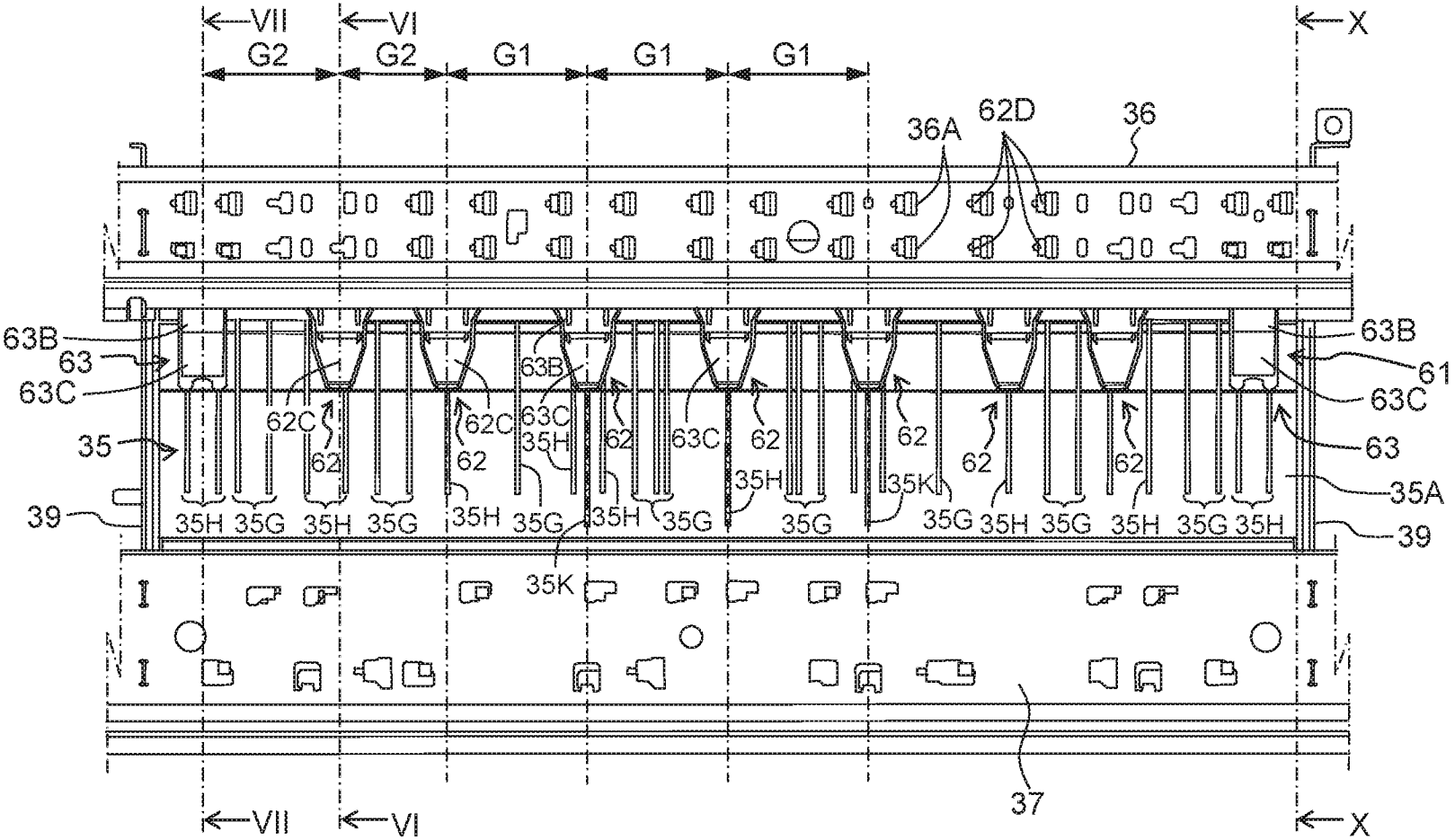
FIG. 3 is a plan view illustrating a first guide rail and a second guide rail.

The first conveyance roller 22 in the pair of conveyance rollers 21 is supported by a sub-frame 39 (refer to FIG. 3) which supports two end portions in the width direction 9 of the first guide rail 36. As shown in FIG. 3, also, each of two end portions in the width direction 9 of the second guide rail 37 is supported by the sub-frame 39. The first conveyance roller 22 rotates in a direction shown by an arrow mark D1 in FIG. 2 by the rotation of a motor which is not shown in the diagram being transmitted to the first conveyance roller 22.

The plurality of pinch rollers 26 is provided at a lower side of the first conveyance roller 22, and each of the plurality of pinch rollers 26 is supported by a roller holder (not shown in the diagram) in a state of leaving a distance from the other pinch roller in the width direction. The roller holder is movable such that each pinch roller 26 assumes a state of being separated apart from a state of being in a contact with the first conveyance roller 22. Each pinch roller 26 that is in contact with the first conveyance roller rotates following the rotation of the first conveyance roller 22.

<Upstream Wavy Shape Applying Mechanism>

Figure 4:
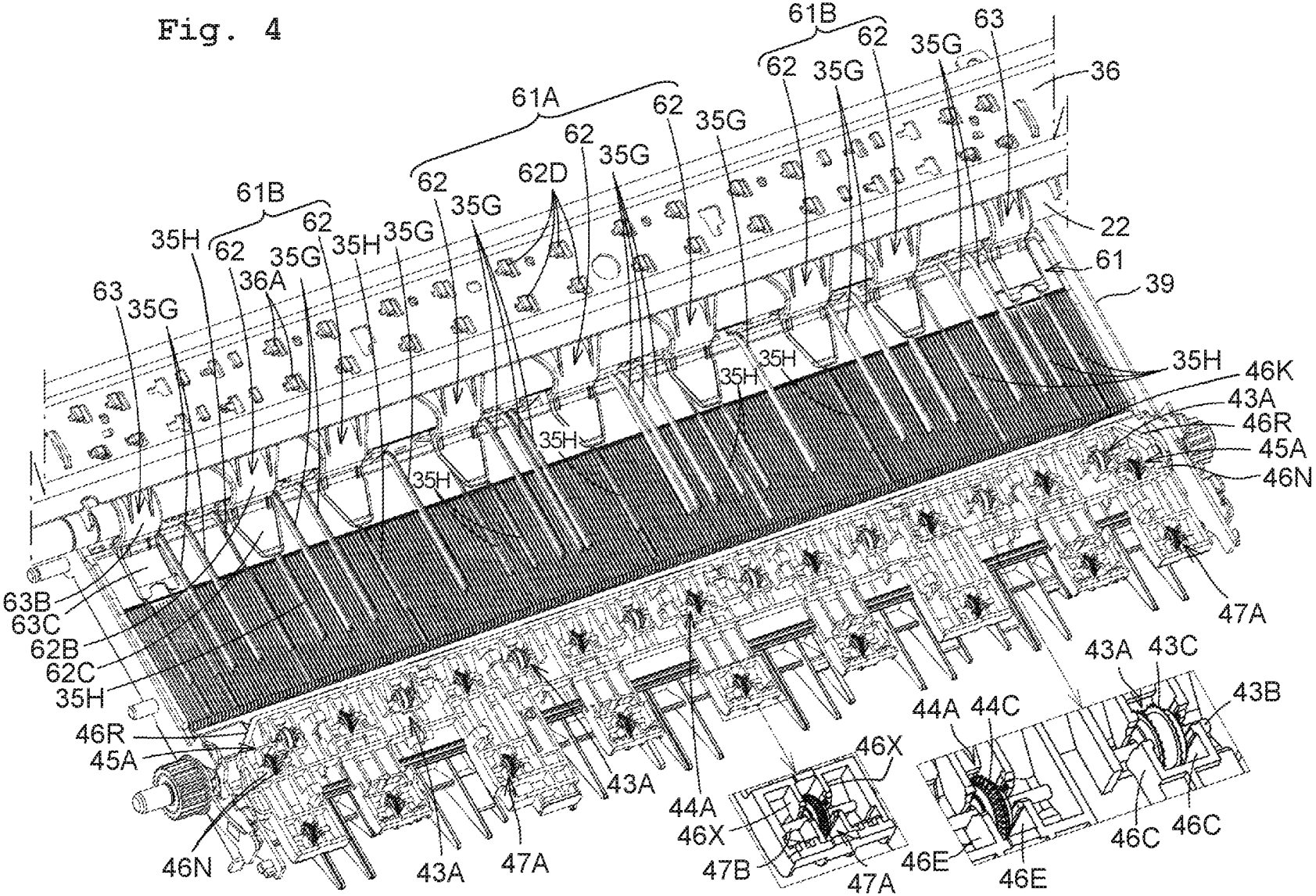
FIG. 4 is a perspective view illustrating a state in which the second guide rail is removed from FIG. 3.

As shown in FIG. 3 and FIG. 4, the upstream wavy shape applying mechanism 61 includes seven upstream abutting members 62 that are installed on a lower surface of the first guide rail 36, and two end-portion abutting members 63 that are provided to the two end portions in the width direction 9. Moreover, a main rib 35G to be described later, which is provided to the platen 35, is also included in the upstream wavy shape applying mechanism 61.

Out of the seven upstream abutting members 62, three upstream abutting members 62 positioned at a central portion in the width direction 9 form a central wavy shape applying portion 61A, and two upstream abutting members 62 provided at two sides of the width direction 9 with respect to the central wavy shape applying mechanism 61A form one set of side wavy shape applying portion 61B. The upstream abutting member 62 at the center in the central wavy shape applying portion 61A is provided at a position corresponding to a center of the platen 35 in the width direction 9. The three upstream abutting members 62 that form the central wavy shape applying portion 61A are arranged leaving a constant (fixed) distance G1 in between. The three upstream abutting members 62 are provided for imparting the wavy shape to the recording paper 14 of size A4 and not for imparting the wavy shape to a recording paper of a shorter length (such as a postcard) along the width direction 9, with which only the three upstream abutting members 62 abut. In a case in Which a postcard is conveyed, by the three upstream abutting members 62 being abut with the postcard, the overall platen 35 moves downward. Accordingly, the wavy shape is not imparted to the postcard.

As shown in FIG. 3, the two upstream abutting members 62 which form the side wavy shape applying portion 619 are arranged leaving a distance G2 shorter than the distance G1. The upstream abutting members 62 at the two ends in the width direction 9 of the central wavy shape applying portion 61A, and the upstream abutting member 62 which has come close to the central wavy shape applying portion 61A in the side wavy shape applying portion 619, are at a distance same as the distance G1.

Figure 6:
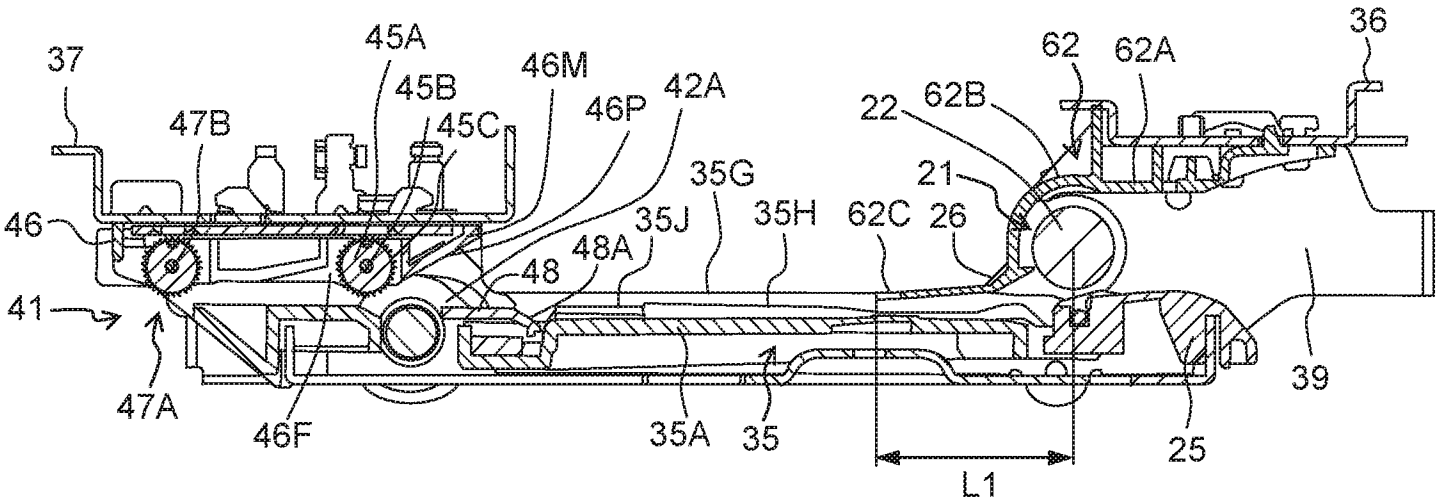
FIG. 6 is a sectional view taken along a line VI-VI in FIG. 3.

Each of the seven upstream abutting members 62 has the same shape, and as shown in FIG. 6, includes a base portion 62A installed on the lower surface of the first guide rail 36, a connecting portion 62B which has assumed a state of being suspended (trailed) from the base portion 62A, and an abutting portion 62C which is installed at a lower-end portion of the connecting portion 62B. The upstream abutting member 62 is formed integrally of a synthetic resin (such as polyacetal (POM)).

The base portion 62A is arranged along the lower surface of the first guide rail 36, and has a plurality of latching portions 62D that are to be latched with the first guide rail 36. Each latching portion 62D is projected upward from the base portion 62A. The first uncle rail 36 is provided with openings 36A in which the respective latching portions 62D are inserted.

The connecting portion 62B is in the form of a band plate with almost fixed (constant) length along the width direction 9, and is formed to have a shape of a curve projected frontward, to be along an outer peripheral portion of the first conveyance roller 22 from a front-end portion of the base portion 62A. The front-end portion of the connecting portion 62B is positioned at a front side and at a lower side of the base portion 62A. The connecting portion 629 has a flexibility that allows it to move in the vertical direction 7 and the frontward-rearward direction 8.

The abutting portion 62C provided at a lower-end portion of the connecting portion 62B is in the form of a flat plate, and in a plan view, is formed to be triangular shaped, with a length in the width direction becoming gradually shorter toward the front side. The abutting portion 62C is positioned upstream in the conveyance direction of the recording paper 14, of a position of the nozzle 34 in the recording section 31.

The abutting portion 62C is inclined to be positioned such that a front-end portion positioned downstream in the conveyance direction is positioned at the lowest side. Moreover, the front-end portion of the abutting portion 62C is lower than an upper-end portion of the main rib 35G provided to the platen 35.

As shown in FIG. 6, a position, at which the abutting portion 62C of the upstream abutting member 62 abuts against an upper surface of the recording paper 14, is separated apart by a distance L1 downstream of the sheet conveying direction 6 from a nip position NP1 at which the recording paper 14 is pinched by the pair of conveyance rollers 21.

Figure 7:
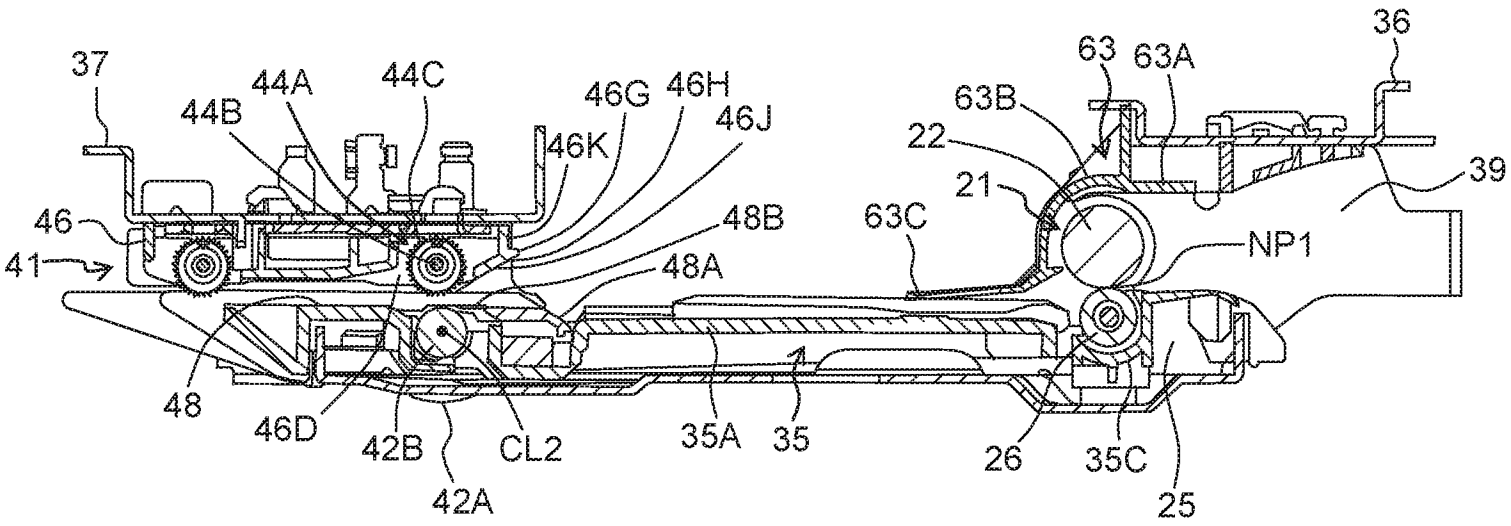
FIG. 7 is a sectional view taken along a line VII-VII in FIG. 3.

The end-portion abutting member 63 provided on each of the two sides in the width direction 9 of all the upstream abutting members 62, as shown in FIG. 7, has a base portion 63A, a connecting portion 6313, and an abutting portion 63C, similarly as the upstream abutting member 62. The abutting portion 63C is formed to be rectangular shaped in a plan view. The rest of the arrangement of the end-portion abutting member 63 is substantially similar to the arrangement of the upstream abutting member 62. The abutting portion 63C of the end-portion abutting member 63 pushes downward the two end portions in the width direction 9 of the recording paper 14 conveyed by the pair of conveyance rollers 21.

<Platen>

As shown in FIG. 6 and FIG. 7, an end portion of the platen 35, which is positioned upstream of the sheet conveying direction 6, is positioned at a lower side of the first guide rail 36, and an end portion of the platen 35, which is positioned downstream in the sheet conveying direction 6 is positioned at a lower side of the second guide rail 37. The platen 35 has a platen main-body portion 35A stretching from a lower-side position of the upstream abutting member 62 up to an upstream position in the sheet conveying direction 6 of a position at which the recording paper 14 is pinched by a second conveyance roller 42A and a first spur roller 43A.

The platen main-body portion 35A is in the form of a band plate along the width direction 9 which is orthogonal to the sheet conveying direction 6. The platen main-body portion 35A abuts against a roller shaft 42B of the second conveyance roller 42A, and is pivotably supported with the roller shaft 42B as a center of pivoting.

The platen main-body portion 35A in the form of a flat plate is provided with three main ribs 35G between the adjacent upstream abutting members 62 in the central wavy shape applying portion 61A. Each of the main ribs 35A is projected upward from an upper surface of the platen main-body portion 35A, in a state along the frontward-rearward direction 8. Moreover, one main rib 35G having the same arrangement is provided also between each of the upstream abutting members 62 on two sides in the width direction 9 of the central wavy shape applying portion 61A and the upstream abutting member 62 which is close to the central wavy shape applying portion 61A in the side wavy shape applying portion 61B.

Furthermore, two main ribs 35G having a similar arrangement are provided at an interval in the width direction 9 also between the pair of upstream abutting members 62 in the side wavy shape applying portion 619. Moreover, two main ribs 35G having a similar arrangement are provided at an interval in the width direction 9, each between the end-portion abutting member 63 and the upstream abutting member 62 that is close to the end-portion abutting member 63 in the side wavy shape applying portion 61B.

The main ribs 35G are projected to a uniform height from the upper surface of the platen main-body portion 35A, and an upper surface of each main rib 35G is flat and has substantially the same height. Each of the main ribs 35G is extended from an end portion of an upstream in the sheet conveying direction 6 of the platen main-body portion 35A up to a position downstream of the middle of the sheet conveying direction 6.

Furthermore, the platen main-body portion 35A is provided with one sub-rib 35H at a position corresponding to a lower side of the upstream abutting member 62 at a center of the central wavy shape applying portion 61A. The sub-rib 3514 is projected upward from the upper surface of the platen main-body portion 35A. An upper surface of the sub-rib 35H is low at a lower side of the upstream abutting member 62 at the center, and is inclined to be gradually higher toward the downstream of the sheet conveying direction 6 from the upstream abutting member 62. Furthermore, at the downstream of the sheet conveying direction 6 in continuation with the inclined portion, the sub-rib 35H has a constant projection height lower than the projection height of the main rib 35G. A downstream position in the sheet conveying direction 6 of the sub-rib 35H and a downstream position in the sheet conveying direction 6 of the main rib 35G are substantially the same positions.

Moreover, a pair of sub-ribs 35H having a similar arrangement is provided at an interval in the width direction 9 at a lower side of the upstream abutting member 62 at the two ends in the width direction 9 of the central wavy shape applying portion 61A. Between the pair of sub-ribs 35H, one auxiliary rib 35K is provided at a downstream position in the sheet conveying direction 6 with respect to the sub-rib 35H. The auxiliary rib 35K has a substantially similar arrangement as the sub-ribs 35H on two sides, except for being shifted downstream in the sheet conveying direction 6.

The platen main-body portion 35A, even at a lower side of each upstream abutting member 62 in the side wavy shape applying portion 61B, is provided with one sub-rib 35H each, having a similar arrangement. Moreover, the platen main-body portion 35A, even at positions on both outer sides in the width direction 9 of the side wavy shape applying portion 61B, is provided with one sub-rib 35H having a similar arrangement.

An upper portion of the abutting portion 62C of the upstream abutting member 62 is flat, and as aforementioned, is lower than the main rib 35G provided to the platen main-body portion 35A. Consequently, as the abutting portion 62C abuts against the upper surface (first surface) of the recording paper 14, the recording paper 14 assumes a state of being caved in (dented) in the form of a recess between the main ribs 35G positioned at the both outer sides in the width direction 9 of the abutting portion 62G.

One or the plurality of sub-ribs 35H is positioned between the adjacent main ribs 35G, and as the recording paper assumes the state of being caved in (dented) in the form of a recess by the abutting portion 62C, each sub-rib 35H supports a lower surface of the portion of the recording paper 14 that is caved in (dented) in the form of a recess. The pair of auxiliary ribs 35K guides end portions on two sides in the width direction 9 of a recording paper of a small size to the downstream wavy shape applying mechanism 41, such that a wavy shape is not imparted by the central wavy shape applying portion 61A.

<Downstream Wavy Shape Applying Mechanism>

As shown in FIG. 6 and FIG. 7, the downstream wavy shape applying mechanism 41 includes a plurality of second conveyance rollers 42A arranged along the width direction 9, a first guide member 46 arranged at an upper side of the second conveyance roller 42A, a plurality of first spur rollers 43A, each supported by the first guide member 46, a plurality of second spur rollers 44A, and a third spur roller 45A.

The plurality of second conveyance rollers 42A abuts against a lower surface (second surface) which is reverse of the upper surface (first surface) of the recording paper 14 having an image recorded in the recording section 31. One roll shaft 42B is inserted through a central portion of each second conveyance roller 42A. Each of the first spur roller 43A, the second spur roller 44A, and the third spur roller 45A abuts against the upper surface of the recording paper 14. The plurality of first spur rollers 43A is arranged to be facing the upper side of the second conveyance rollers 42A respectively.

A second guide member 48 which guides the recording paper 14 conveyed from the platen main-body portion 35A to the upper side of the second conveyance roller 42A, is provided at a downstream in the sheet conveying direction 6 of the platen main-body portion 35A. The roller shaft 42B is arranged at an axial center portion of the second conveyance roller 42A. The second guide member 48 is provided with a plurality of opening portions 48B (refer to FIG. 7) at an interval in the width direction 9, at an upper side of the roller shaft 42B. The opening portions 48B are provided at a position corresponding to the downstream of the sheet conveying direction 6 between the adjacent upstream abutting members 62, at a position corresponding to the downstream of the sheet conveying direction 6 between the end-portion abutting member 63 and the upstream abutting member 62 adjacent to the respective end-portion abutting member 63, and a position corresponding to the downstream of the sheet conveying direction 6 of the upstream abutting member 62 and the end-portion abutting member 63. The second conveyance roller 42 is arranged inside each of the opening portions 48B provided at the corresponding position between the adjacent upstream abutting member 62, and the corresponding position between the end-portion abutting member 63 and the upstream abutting member 62 adjacent to the end-portion abutting member 63. The second conveyance roller 42A has a part thereof projected toward the upper side of the second guide member 48, through the opening portion 48B of the second guide member 48.

As shown in FIG. 6 and FIG. 7, the second guide member 48 is provided with a lower guide surface (an example of a "third guide surface" of the present teaching) which guides the recording paper 14 from the platen main-body portion 35A to the second conveyance roller 42A. The lower-portion guide surface 48A is inclined such that a distance up to an axial center CL1 (refer to FIG. 8) of the first spur roller 43A in a direction orthogonal to the width direction 9 and the sheet conveying direction 6 becomes closer toward the downstream of the sheet conveying direction 6.

Each of the second conveyance rollers 42A is made of an elastic member such as rubber, to be circular cylindrical shaped, and is fitted coaxially to the roller shaft 42B. Each of these eight second conveyance rollers 42A is projected upward from an upper surface of the second guide member 48. The roller shaft 42B is rotated in a direction shown by an arrow mark D2 in FIG. 2, by the rotational force of a motor being transmitted thereto via a transmission mechanism not shown in the diagram. Accordingly, all the second conveyance rollers 42A rotate integrally.

The first guide member 46 which supports each of the first spur roller 43A, the second spur roller 44A, and the third spur roller 45A is arranged at an upper side of the conveying path 29. A length of the first guide member 46 in the width direction 9 is longer than a length in the sheet conveying direction 6. As shown in FIG. 6, the first spur roller 43A which is arranged face-to-face at the upper side of the second conveyance roller 42A is supported by an end portion downstream in the sheet conveying direction 6 of the first guide member 46.

As shown by magnifying in FIG. 4, the first spur roller 43A is provided with two spur portions 43C having a circular plate shape, at an interval in the width direction 9. An outer peripheral surface of each spur portion 43C is provided with projections and recesses along a circumferential direction. A roller shaft 43B along the width direction 9 is inserted through an axial center portion of the first spur roller 43A. The first guide member 46 is provided with a roller supporting portion 46C arranged along the frontward-rearward direction 8, on two sides in the width direction 9 of the first spur roller 43A, and two end portions in the width direction 9 of the roller shaft 43B are rotatably supported by the roller supporting portions 46C respectively.

Figure 8:
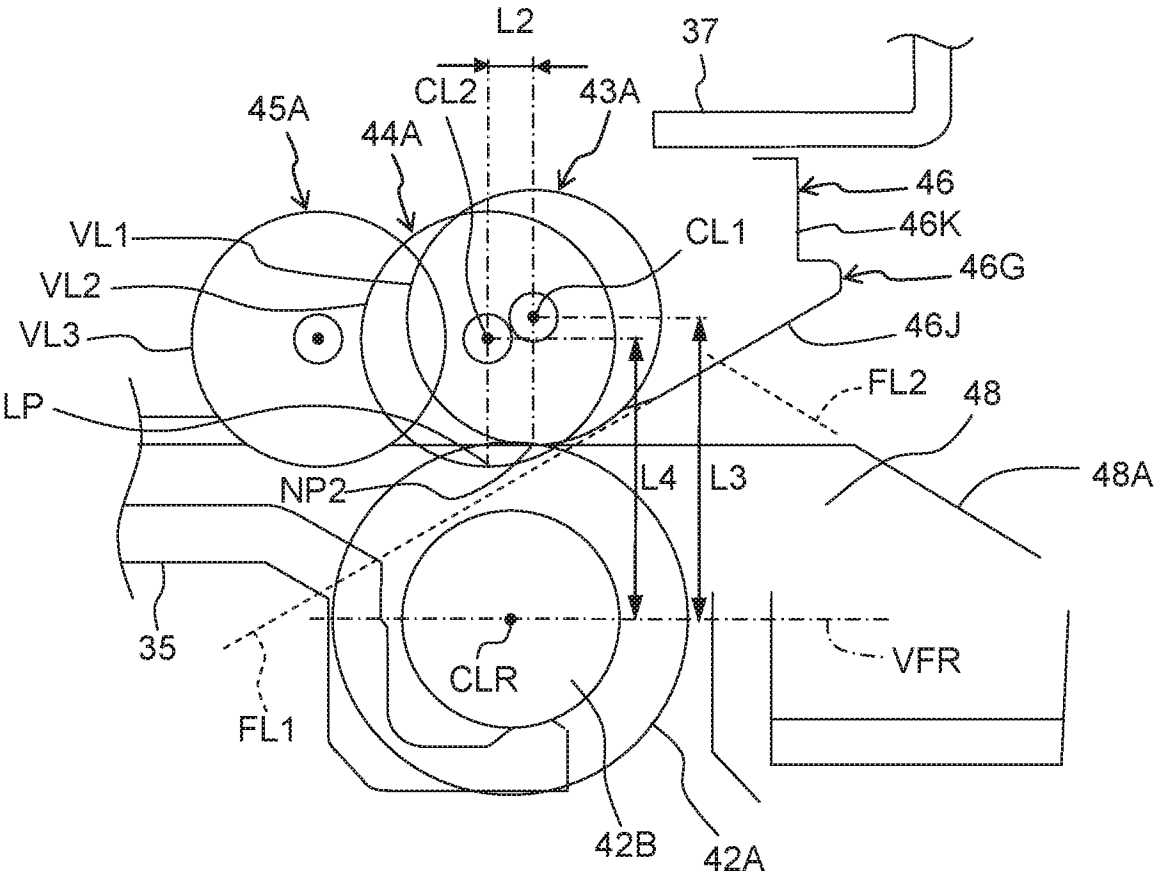
FIG. 8 is a schematic view illustrating a structure of a downstream wavy shape applying mechanism.

FIG. 8 is a schematic diagram for explaining an arrangement of the downstream wavy shape applying mechanism 41. In FIG. 8, the first spur roller 43A, the second spur roller 44A, and the third spur roller 454 are indicated by circular virtual peripheral lines along an outer periphery, namely, a first virtual outer peripheral line VL1, a second virtual outer peripheral line VL2, and a third virtual outer peripheral line VL3 respectively.

The first virtual outer peripheral line VL1 having a circular shape along the outer periphery of the first spur roller 43A makes a contact with an outer peripheral surface of the second conveyance roller 424 on the lower side, and as the second conveyance roller 42A rotates, the first spur roller 434 rotates following the rotation of the second conveyance roller 42A. A position at which the first virtual outer peripheral line VL1 of the first spur roller 43A makes a contact with the second conveyance roller 42A is a nip position NP2 at which the recording paper 14 is pinched, and the recording paper 14 that is conveyed from the platen 35 is pinched at the nip position NP2, and conveyed downstream in the sheet conveying direction 6.

Figure 5:
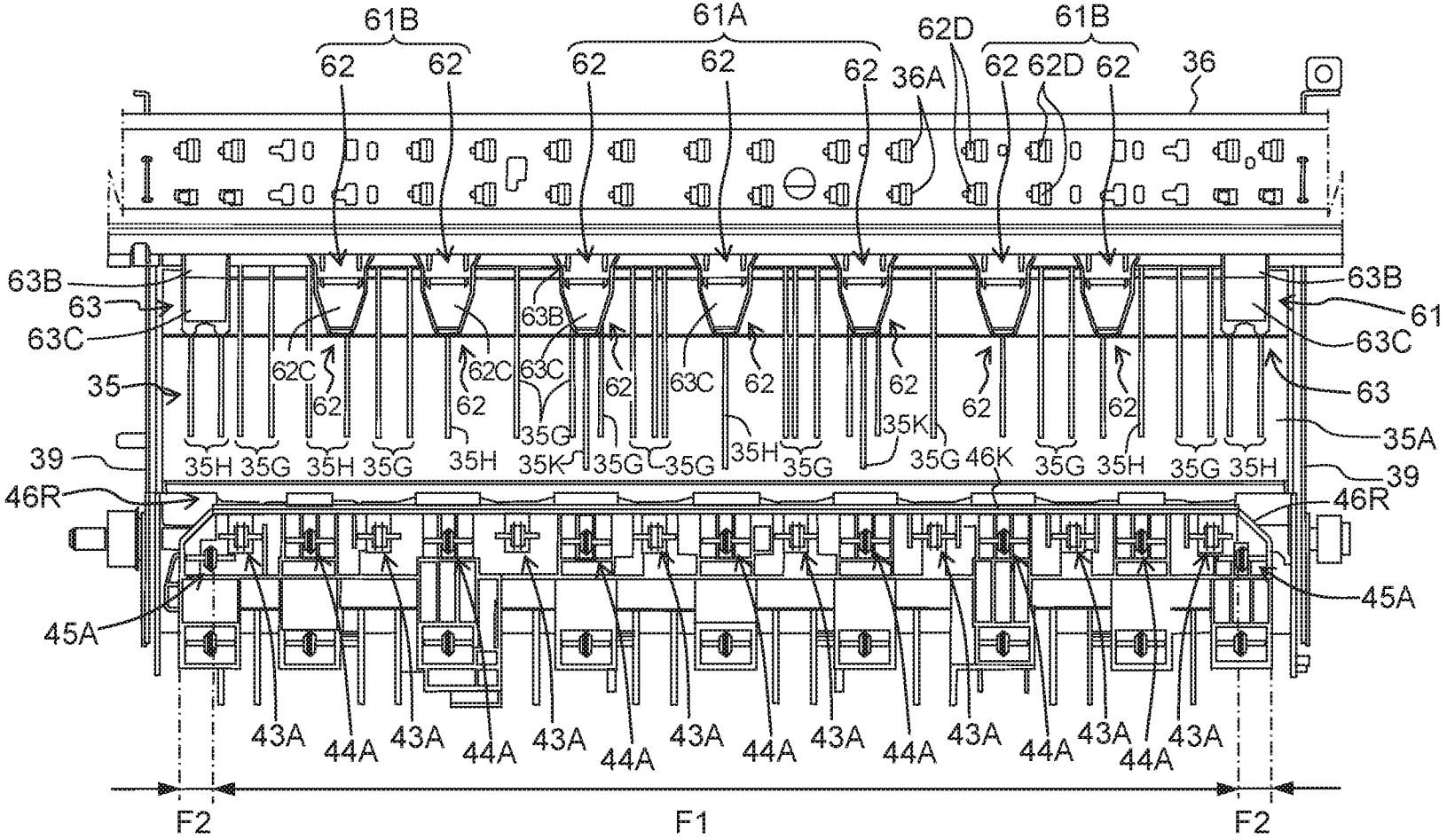
FIG. 5 is a plan view of FIG. 4.

As shown in FIG. 5, each second spur roller 44A, at a corresponding position between the adjacent second conveyance rollers 42A, is supported by the first guide member 46. Each second spur roller 44A corresponds to coincides with) a position in the width direction 9 with respect to a respective upstream abutting member 62 from among the seven upstream abutting members 62 in the aforementioned upstream wavy shape applying mechanism 61, and each second spur roller 44*a* is positioned downstream in the sheet conveying direction of each upstream abutting member 62.

Each second spur roller 44A, as shown magnified in FIG. 4, has one spur portion 44C having a shape similar to each spur portion 43C of the first spur roller 43A, and a roller shaft 44B in the width direction 9 is inserted through an axial center portion of each second spur roller 44A. Two end portions in the width direction 9 of the roller shaft 44B are rotatably supported by second roller supporting portions 46E provided along the frontward-rearward direction 8 to the first guide member 46.

As shown in FIG. 8, the second spur roller 44A, from a viewpoint along the width direction 9, overlaps with the nip position NP2. In other words, from a viewpoint along the width direction 9, the nip position NP2 is positioned inside the second virtual outer peripheral line VL2 having a circular shape along the outer periphery of the second spur roller 44A. An axial center CL2 of the second spur roller 44A is at a position lower than the axial center CL1 of the first spur roller 43*a*. In other words, a distance L4 (in the up-down direction 7) between the axial center CL2 of the second spur roller 44A in a direction (up-down direction 7) orthogonal to each of the sheet conveying direction 6 and the width direction 9 and a virtual plane VFR along the sheet conveying direction 6 including an axial center CLR of the second conveyance roller 42A, is shorter than a distance L3 between the axial center CL1 of the first spur roller 434 and the virtual plane VFR.

In this case, a position LP, at which a distance between the second virtual outer peripheral line VL2 having a circular shape along the outer periphery of the second spur roller 44A and the virtual plane VFR that includes the axial center CLR of the second conveyance roller 42A becomes the shortest, is separated apart only by a distance L2 downstream in the conveyance direction of the nip position NP2, at which the recording paper 14 is pinched by the second conveyance roller 42A and the first spur roller 43A, the recording paper 14 abuts against the position LP at the shortest distance. Consequently, at a position separated apart by the distance L2 downstream in the conveyance direction of the nip position NP2, the second spur roller 44A abuts with the maximum pressure exerted to the recording paper 14. The distance L2 is shorter than the distance L1 from the nip position NP1 at which the recording paper 14 is pinched by the pair of conveyance rollers 21 up to a position, at which the abutting portion 62C of the upstream abutting member 62 abuts against the upper surface of the recording paper 14. The position, at which the abutting portion 62C of the upstream abutting member 62 abuts against the upper surface of the recording paper 14 is equivalent to a position, at which the distance from the virtual plane VFR along the conveyance direction that includes the axial center CLR of the second conveyance roller 42A becomes the shortest.

As shown in FIG. 4 and FIG. 5, the third spur rollers 45A are supported by two end portions in the width direction 9 of the first guide member 46. The third spur rollers 45A are arranged at positions corresponding to the downstream in the sheet conveying direction 6 of the two end-portion abutting members 63 respectively, in the upstream wavy shape applying mechanism 61, which are positions corresponding to the downstream in the sheet conveying direction 6 of the second spur rollers 44A.

The third spur roller 45A has an arrangement similar to the second spur roller 44A. A roller shaft 45B of the third spur roller 45A, as shown in FIG. 4, is rotatably supported by a third roller supporting portion 46N provided to the first guide member 46 along the frontward-rearward direction 8. As shown in FIG. 8, the shortest distance of the third spur roller 45A from the virtual plane VFR that includes the axial center CUR of the second conveyance roller 42A and the shortest distance of the second spur roller 44A from the virtual plane VFR that includes the axial center CLR of the second conveyance roller 42A are substantially the same. Consequently, a position of the third spur roller 45A in the vertical direction 7 abutting with the recording paper 14 and a position of the second spur roller 44A in the vertical direction 7 abutting with the recording paper 14 are substantially the same.

As shown in FIG. 4, forth spur rollers 47A are supported by the first guide members 46 respectively, at positions corresponding to downstream in the sheet conveying direction 6 of all the second spur rollers 44A respectively, and at a position corresponding to downstream in the sheet conveying direction 6 of each third spur roller 45A.

The fourth spur roller 47A has an arrangement similar to the second spur roller 44A, and a roller shaft 47B is rotatably supported by a fourth roller supporting portion 46X provided along the frontward-rearward direction 8 to the first guide member 46. As shown in FIG. 6 and FIG. 7, the shortest distance of the fourth spur roller 47A from the virtual plane VFR which includes the axial center CLR of the second conveyance roller 42, and the shortest distance of the second spur roller 44A from the virtual plane VFR which includes the axial center CLR of the second conveyance roller 42 are substantially the same. Consequently, a position of the fourth spur roller 47A in the vertical direction 7 abutting with the recording paper 14 and a position of the second spur roller 44A in the vertical direction 7 abutting with the recording paper 14 are substantially the same.

As shown in diagrams from FIG. 4 to FIG. 7, an upstream end portion in the sheet conveying direction 6 of the first guide member 46 is provided with a wall surface 46K erected perpendicularly along the width direction 9. The wall surface 46K is positioned downstream in the sheet conveying direction 6 with respect to the platen main-body portion 35A of the platen 35, and near the platen main-body portion 35A. The wall surface 46K, as shown in FIG. 5, is arranged to spread over a first range F1 along the width direction 9, in which all the first spur rollers 43A supported by the first guide member 46 are supported.

Figure 9:
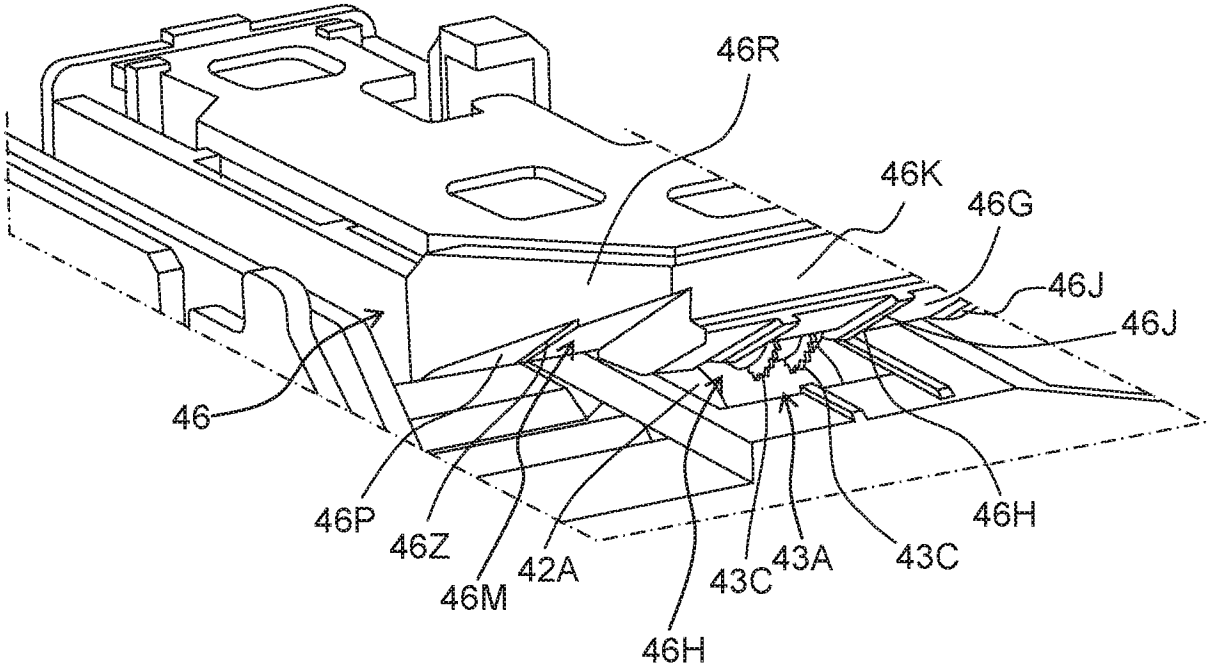
FIG. 9 is a perspective view illustrating a part of a first guide member.

As shown in FIG. 9, a lower end portion of the wall surface 46K is provided with a first guide portion 46G which is extended downward and downstream of the sheet conveying direction 6. The first guide portion 46G is provided over the entire area of the wall surface 46K in the width direction, and consequently is arranged to be spread over the first range.

As shown in FIG. 6, the first guide portion 46G is inclined such that, a distance of the first guide portion 46G from the axial center of the second conveyance roller 42A in the conveyance direction and the direction orthogonal to the width direction 9 becomes shorter gradually from the upstream toward the downstream of the sheet conveying direction 6. The first guide portion 46G is provided with a plurality of guide ribs 46H projected from the first guide portion 46G, at an interval in the width direction 9. Each guide rib 46H is provided along the direction of inclination of the first guide portion 46G, and a front-end surface of a projected side of each first guide portion 46G similar to the first guide portion 46G, is a first guide surface 46J which is inclined such that a distance from the axial center of the second conveyance roller 42A in the conveyance direction and the direction orthogonal to the width direction 9 becomes gradually shorter from the upstream toward the downstream of the conveyance direction. The first guide surface 46J, as shown in FIG. 8, intersect with a virtual straight line FL2 along a lower-portion guide surface 48A which is provided to the second guide member 48 of the platen 35.

As shown in FIG. 9, end portions on two sides in the width direction 9 of the wall surface 46K of the first guide member 46 are provided with end-portion guide surfaces 46R extended in the sheet conveying direction 6 and both outer sides of the wall surfaces 46K respectively. The end-portion guide surfaces 46R are arranged in a second range F2 on both outer sides in the width direction with respect to the first range F1, in which the first guide portion 46G is provided, and the end-portion guide surfaces 46R are inclined such that a distance along the width direction 9 from the first range F1 becomes gradually longer from the upstream toward the downstream of the conveyance direction. In other words, the end-portion guide surface 46R are inclined with respect to the sheet conveying direction 6 and the width direction 9, and are inclined such that the most downstream position in the sheet conveying direction 6 is positioned on both outer sides in the width direction 9 of the most upstream position.

Figure 10:
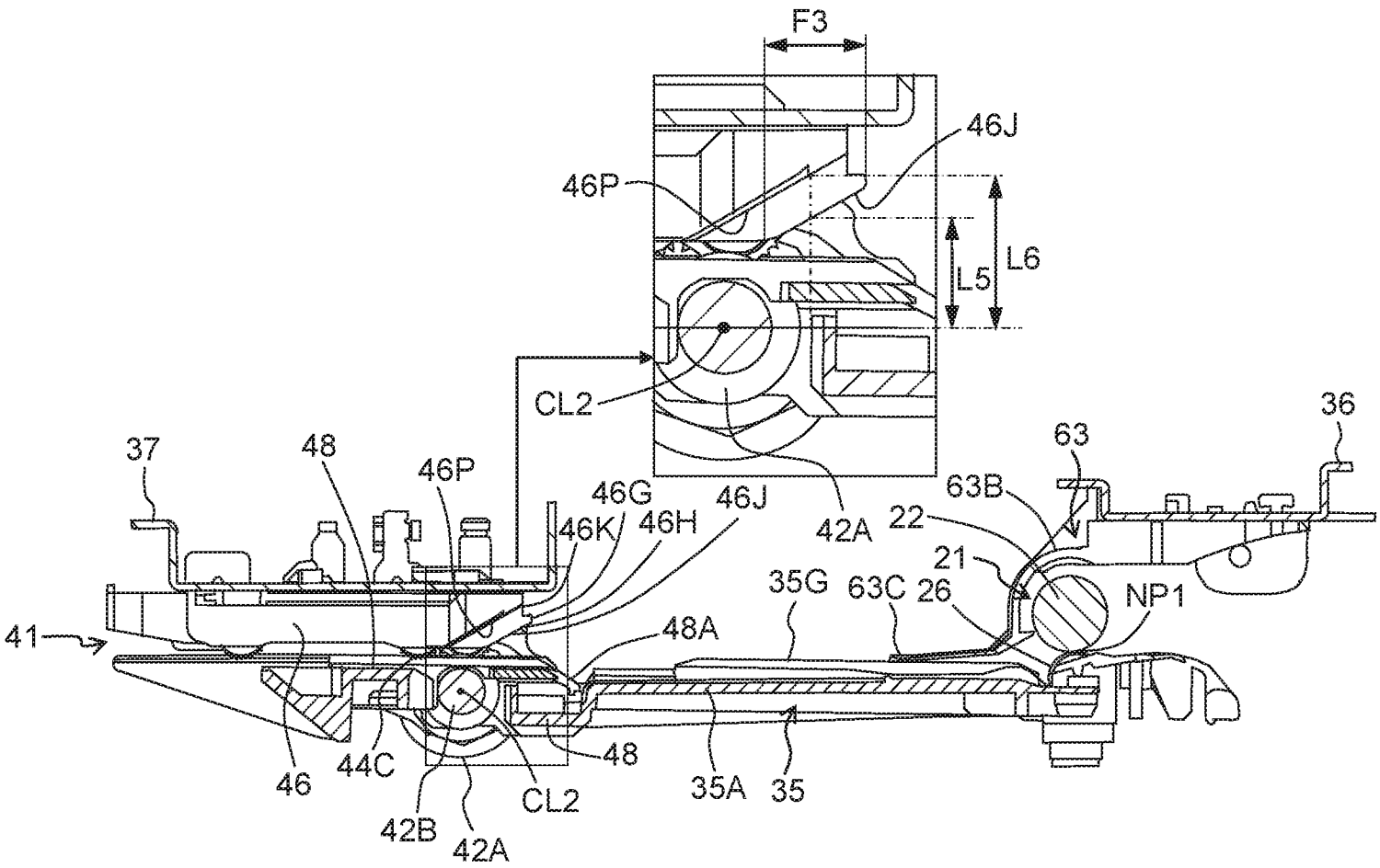
FIG. 10 is a sectional view taken along a line X-X in FIG. 3.

As shown in FIG. 9 and FIG. 10, a lower end of the end-portion guide surface 46R is provided with second guide portion 46M continuously that is extended downstream and downward of the sheet conveying direction 6. The second guide portion 46M, similarly as the end-portion guide surface 46R, is arranged in the second range F2 on both outer sides of the width direction 9 with respect to the first range F1. The second guide portion 46M has a second guide surface 46P which is in an inclined state coming closer gradually to the virtual plane VFR that includes the axial center CLR of the second conveyance roller 42A, from the upstream toward the downstream of the sheet conveying direction 6. The second guide surface 46P is in the inclined state similarly as the first guide surface 46J, and is inclined such that, a distance from the axial center of the second conveyance roller 42A in the direction orthogonal to the width direction 9 and the sheet conveying direction 6 becomes gradually shorter from the upstream toward the downstream of the conveyance direction.

In this case, as shown in FIG. 10, in a range, in which the first guide surface 46J in the sheet conveying direction 6 is provided, a distance L5 between the axial center of the second conveyance roller 42A and the first guide surface 46J in the direction orthogonal to the width direction 9 and the sheet conveying direction 6 becomes shorter than a distance L6 between the axial center of the second conveyance roller 42A and the second guide surface 46P in the direction orthogonal to the width direction 9 and the sheet conveying direction 6, in a range F3, in which the second guide surface 46P in the sheet conveying direction 6 is provided. Moreover, the most downstream position of the second guide surface 46P in the sheet conveying direction 6 is between the second spur roller 44A and the first spur roller 43A in the sheet conveying direction 6.

The second guide surface 46P is in an inclined state similarly as the first guide surface 46J, and at a central portion in the width direction 9, a step 46Z is formed along the direction of inclination of the second guide surface 46P. The step 46Z is formed by end portions positioned on both outer sides in the width direction 9 of each second guide surface 46P being positioned downstream in the sheet conveying direction 6 of a portion positioned at a center in the width direction 9 of the step 46Z.

The second guide surface 46P is positioned downstream in the sheet conveying direction 6 of the first guide surface 46J, and is arranged to be spread over from an upstream position up to a downstream position in the sheet conveying direction 6, with respect to the nip position NP2 between the second conveyance roller 42A and the first spur roller 43A.

As shown in FIG. 8, the second virtual outer peripheral line VL2 having a circular shape along the outer periphery of the second spur roller 44A is arranged not to overlap with a virtual straight line FL1 along the first guide surface 46J from a viewpoint along the width direction 9, with respect to the first guide surface 46J of the first guide member 46. In other words, a position of the second virtual outer peripheral line VL2 of the second spur roller 44A, at which the distance from the virtual plane VFR becomes the shortest, is at the downstream in the sheet conveying direction 6 of the nip position NP2.

Moreover, the first virtual outer peripheral line VL1 of the first spur roller 43A does not overlap with the virtual straight line FL1 along the first guide surface 46J from a viewpoint along the width direction 9. In other words, even the first spur roller 43, from a viewpoint along the width direction 9, is positioned downstream in the sheet conveying direction of the virtual straight line FL1 along the first guide surface 46J.

<Action of Upstream Wavy Shape Applying Mechanism, Platen, and Downstream Wavy Shape Applying Mechanism>

In the multifunction peripheral 10 having such arrangement, as the recording paper 14 in the feeding tray 13 is conveyed with center reference from the feeding path 15C in the feeding guide member 15 to the pair of conveyance rollers 21, the recording paper 14 is pinched between the first conveyance roller 22 and the pinch roller 26, and conveyed to the platen 35. At this time, the front-end portions of the abutting portions 62C of the seven upstream abutting members 62 abut with the upper surface of the recording paper 14 conveyed by the pair of first conveyance rollers 21, at positions separated apart by the distance L1 from the nip position NP1 at which the recording paper 14 is pinched between the pair of first conveyance rollers 21. Accordingly, the recording paper 14 is pushed downward by the respective abutting portions 62C. Moreover, the two end portions in the width direction 9 of the recording paper 14 are pushed downward by the end-portion abutting member 63.

Since the platen main-body portion 35A of the platen 35 is provided with the main ribs 35G on the both outer sides in the width direction 9 of each abutting portion 62C, a portion of the recording paper 14 abutting with the main ribs 35G is not pushed downward, and a portion of the recording paper 14 with which the abutting portion 62C abut between the main ribs 35G assumes a state of being caved in (dented) in the form of a recess. Accordingly, a wavy shape along the width direction 9 is imparted to the recording paper 14. In this case, a lower surface of the portion that has caved in (dented) in the form of a recess is supported by the sub ribs 35H.

An image is recorded at a predetermined position beneath the recording section 31 on the recording paper 14, to which a wavy shape along the width direction 9 is imparted on the platen 35. Thereafter, the recording paper 14 is conveyed to the downstream wavy shape applying mechanism 41.

In the downstream wavy shape applying mechanism 41, a front-end portion downstream in the sheet conveying direction of the recording paper 14 conveyed from the platen 35 is guided to the a lower-portion guide surface 48A provided for the second guide member 48. At this time, since the virtual straight line FL2 along the lower-portion guide surface 48A intersects with the first guide surface 46J of the first guide member 46, the front-end portion at the downstream side in the sheet conveying direction 6 of the recording paper 14 conveyed along the lower-portion guide surface 48A, except for the two end portions in the width direction 9, abuts against the first guide surface 46J of the first guide member 46, and is guided downstream in the sheet conveying direction 6 along the first guide surface 46J. Thereafter, the front-end portion of the recording paper 14, except for the two end portions in the width direction 9, abuts against an outer peripheral surface of the first spur roller 43A which is in a rotating state, and is guided toward the nip position NP2 of the first spur roller 43A and the second conveyance roller 42A.

At this time, each second spur roller 44A is arranged in a state of overlapping with the nip position NP2 from a viewpoint along the width direction 9 orthogonal to the sheet conveying direction 6, and the second virtual outer peripheral line VL2 having a circular shape along the outer periphery of the second spur roller 44A is in a state of not overlapping with the virtual straight line FL1 along the first guide surface 46J, from a viewpoint along the width direction 9. Accordingly, the recording paper 14 which is guided along the first guide surface 46J of the first guide member 46 abuts against the second spur roller 44A before being pinched at the nip position NP2. According to the arrangement of the second spur roller 44A, there is a possibility that the recording paper 14 abuts against the second spur roller 44A at the same time as when pinched at the nip position NP2. In any of the cases, it is possible to make the recording paper 14 to be caved in (dented) easily in the form of a recess by the second spur roller 44A. As a result, a wavy shape along the width direction 9 is imparted to the recording paper 14.

Moreover, an angle of entry (an angle of contact) of the recording paper 14 guided by the first guide surface 46J to the second spur roller 44A is regulated, there is no possibility of a substantial load being exerted on the recording paper 14 when the recording paper 14 abuts against the second spur roller 44A. Accordingly, the recording paper 14 is suppressed from getting damaged, and an occurrence of jamming of the recording paper at the second spur roller 44A is suppressed. Moreover, since the second spur roller 44A overlaps with the nip position in aside view, it is possible to make the recording paper 14 wavy corrugated, crimped) effectively. Consequently, on the platen main-body portion 35A, even when there is a swelling of a portion of the recording paper 14 to which the ink is adhered, an occurrence of cockling is suppressed.

Furthermore, the distance L2 along the conveyance direction from the nip position NP2 of the recording paper 14 pinched between the first spur roller 43A and the second conveyance roller 42A in the downstream wavy shape applying mechanism 41 up to the position at which the second spur roller 44A abuts against the recording paper 14 is shorter than the distance L1 from the nip position NP1 of the recording paper 14 pinched between the pair of conveyance rollers 21 in the upstream wavy shape applying mechanism 61 up to the position at which the abutting portion 62C of the upstream abutting member 62 abuts against the upper surface of the recording paper 14.

In this case, before the upstream abutting member 62 assumes a state of not being abut with the recording paper 14, the second spur roller 44A abuts against the recording paper 14. As a result, it is possible to maintain stably the wavy state of the recording paper 14.

Furthermore, the virtual outer peripheral line VL1 of the first spur roller 43A, from a viewpoint in the width direction 9, does not overlap with the virtual straight line FL1 along the guide surface 46J. Accordingly, there is no possibility of a substantial load being exerted to the recording paper when the recording paper 14 abuts against the first spur roller 43A. As a result, it is possible to suppress damage to the recording paper 14, and jamming of the recording paper 14 at the first spur roller 43A.

Thereafter, the recording paper 14 is pinched between the second conveyance roller 42A and the first spur roller 43A, and is conveyed downstream in the sheet conveying direction 6.

The two end portions in the width direction 9 of the recording paper 14 are guided to the second guide surface 46P of the first guide member 46, after a portion other than the two end portions in the width direction 9 of the recording paper 14 is guided to the first guide surface 46J of the first guide member 46. The two end portions in the width direction 9 of the recording paper 14 guided to the second guide surface 46P pass over an upper side of the second conveyance roller 42A. Thereafter, the two end portions in the width direction of the recording paper 14 abut with the third spur roller 45A. Accordingly, each end portion of the recording paper 14 is pushed down in order from a side portion downstream in the sheet conveying direction 6 by the third spur roller 45A.

In such manner, the two end portions in the width direction 9 of the recording paper 14 being guided to the second guide surface 46P positioned at the downstream in the sheet conveying direction 6 of the first guide surface 46J of the first guide member 46 are pushed down upon being abut smoothly with the third spur roller 45A. Consequently, the recording paper 14 assumes a wavy (corrugated) state along the width direction 9 by being abut with the second spur roller 44A, and even in a state of the two end portions in the width direction 9 of the recording paper being jumped (lifted) upward, the recording paper 14 is pushed down assuredly by the third spur roller 45A. Thereafter, the recording paper 14 is discharged to the paper discharge tray 17 by the fourth spur rollers 47A.

Furthermore, when the recording paper 14 is in an inclined state with respect to the conveyance direction, one of the angular portions in the width direction 9 positioned downstream in the conveyance direction of the recording paper being guided by the end-portion guide surface 46R, abuts against the second guide surface 46P without getting a substantial jolt (impact).

[Function and Effect of Embodiment]

In the present embodiment, the recording paper 14 guided by the first guide surface 46J of the first guide member 46, before reaching the nip position NP2, abuts against the second spur roller 44A. Accordingly, the second spur roller 44A is capable of making the recording paper 14 to be caved in (dented) easily in the form of a recess. Moreover, the recording paper 14 guided by the first guide surface 46, before abutting with the second spur roller 44A, is guided to the nip position NP2 by the first spur roller 43A. Accordingly, there is not possibility of a substantial load being exerted on the second spur roller 44A, and it is possible to suppress jamming of the recording paper 14 at the second spur roller 44A.

Moreover, since the first virtual outer peripheral line VL1 of the first spur roller 43A is positioned downstream in the sheet conveying direction 6 of the virtual straight line FL1 along the first guide surface 46J, the recording paper 14 guided to the first guide surface 46J, before abut with the second spur roller 44A, is guided to the nip position NP2 by the first spur roller 43A. As a result, there is no possibility of a substantial load being exerted on the first spur roller 43A, and it is possible to suppress jamming of the recording paper 14 at the first spur roller 43A.

The third spur roller 45A provided to the first guide member 46 is arranged at a position nearer to the virtual plane VFR than the first spur roller 45A, and downstream in the sheet conveying direction 6 of the second spur roller 44A. Accordingly, the end portion in the width direction of the recording paper 14 is pushed down assuredly by the third spur roller 45*a*.

The second guide surface 46P provided to the first guide member 46 is positioned at the downstream in the sheet conveying direction 6 of the first guide surface 46J. Accordingly, even in a state of the two end portions in the width direction of the recording paper 14 jolted, the recording paper 14 is guided to the third spur roller 45A smoothly, and is pushed down assuredly by the third spur roller 45A.

The second guide surface 46P, in the sheet conveying direction 6, is extended downstream from the upstream of the nip position NP2. Accordingly, the two end portions in the width direction 9 of the recording paper 14 are guided smoothly to the third spur roller 45A by the second guide surface 46P.

As the first guide member 46 supports the first spur roller 43A, the second spur roller 44A, and the third spur roller 45A, positioning of each of the first spur roller 43A, the second spur roller 44A, and the third spur roller 45A becomes easy.

For the second virtual outer peripheral line VL2 of the second spur roller 44A, the position LP, at which the distance from the virtual plane VFR becomes the shortest is positioned at the downstream in the sheet conveying direction 6 of the nip position NP2. Accordingly, since the load is exerted on the recording paper 14 by the second spur roller 44A at the downstream in the sheet conveying direction 6 of the nip position NP2, it is possible to suppress the load exerted on the recording paper 14 at the time of abutting with the second spur roller 44A, and it is possible to suppress jamming and damage of the recording paper 14.

The second guide member 48, is facing to the first guide member 46, and has the lower-portion guide surface 48A which guides the recording paper 14 to the nip position NP2, and from a viewpoint along the width direction 9, the virtual straight line FL1 along the first guide surface 46J intersects with the lower-portion guide surface 48A.

In this case, the recording paper 14 guided to the lower-portion guide surface 48A of the second guide member 48 abuts against the second spur roller 44A after the front end of the recording paper 14 is directed toward the nip position NP2 upon being guided by the first guide surface 46J of the first guide member. Accordingly, there is no possibility of a substantial load being exerted on the recording paper 14 when the recording paper 14 abuts against the second spur roller 44A, and it is possible to suppress jamming of the recording paper 14 at the second spur roller 44A.

Since the second guide member 48 abuts against the roller shaft 42B of the second conveyance roller 42A, and the lower portion guide surface 48A assumes a predetermined state with respect to the second nip position NP2, it is possible to convey the recording paper 14 stably to the second conveyance roller 42A.

MODIFIED EXAMPLE

In the embodiment, the arrangement was such that the first virtual outer peripheral line VL1 having a circular shape along the outer periphery of the first spur roller 434 does not overlap with the virtual straight line FL1 from a viewpoint in the width direction. However, since the first spur roller 43A rotates following the rotation of the discharge roller 42A at the time of conveying the recording paper 14, the load exerted on the recording paper 14 by the first spur roller 43A at the nip position NP2 is small, and therefore the first virtual outer peripheral line VL1 may overlap with the virtual straight line FL1. Moreover, an arrangement, in which the first guide member 46 is not provided with the third spur roller 45A, and an arrangement, in which the first guide member 46 is not provided with the second guide surface 46P may be adopted. In this case, a second area (range) F2 of the first guide member 46 is provided with an inclined surface similar to the first guide portion 46G.

Furthermore, without restricting to the arrangement of the first spur roller 43A, the second spur roller 44A, and the third spur roller 45A being supported by the first guide member 46, an arrangement may be such that the first spur roller 43A, the second spur roller 44A, and the third spur roller 45A are supported by a member other than the first guide member 46.

Without restricting to the arrangement, in which for the second virtual outer peripheral line VL2 of the second spur roller 44A, the position, at which the distance from the virtual plane VFR becomes the shortest is positioned at the downstream in the sheet conveying direction 6 of the nip position NP2 an arrangement may be such that the position, at which the distance from the virtual plane VFR becomes the shortest is upstream in the sheet conveying direction 6 of the nip position NP2.

Moreover, without restricting to the arrangement, in which the second guide member 48 is positioned upon being abut with the roller shaft 42B of the second conveyance roller 42A, an arrangement may be such that the second guide member 48 is positioned with respect to another member.

What is claimed is:

1. An image recording apparatus comprising:

a recording unit configured to record an image on a surface of a sheet conveyed in a conveyance direction when the sheet is positioned at a recording position, the conveyance direction being parallel to a surface of the recording unit from which ink is dispensed;

conveyance rollers arranged downstream of the recording unit in the conveyance direction to be apart from each other in a width direction orthogonal to the conveyance direction;

first spur rollers arranged opposingly to the conveyance rollers respectively, and configured to nip the sheet between the conveyance rollers and the first spur rollers, the first spur rollers having a first rotation axis common to the first spur rollers;

second spur rollers arranged between the mutually adjoining first spur rollers respectively in the width direction and having a second rotation axis which is different from the first rotation axis and common to the second spur rollers, the second rotation axis being positioned downstream of the first rotation axis in the conveyance direction; and a first guide member arranged on the same side as the recording unit with respect to the surface of the sheet, on which the recording unit is configured to record the image, when the sheet is positioned at the recording position, the first guide member being further arranged downstream of the recording unit in the conveyance direction and having a first guide surface arranged upstream of the first spur rollers and the second spur rollers in the conveyance direction, the first guide surface being configured to guide the sheet to a nip position at which the sheet is nipped by the conveyance rollers and the first spur rollers, wherein, as viewed in the width direction:

each of the second spur rollers overlaps with the nip position, a circular virtual outer circumferential line along an entirety of an outer circumference of each of the second spur rollers does not intersect with a virtual straight line extending along the first guide surface and beyond the second spur rollers in the conveyance direction, a distance between the first rotation axis of the first spur rollers and the second rotation axis of the second spur rollers is smaller than a radius of a circular virtual outer circumferential line along an entirety of an outer circumference of each of the first spur rollers, and the distance between the first rotation axis of the first spur rollers and the second rotation axis of the second spur rollers is smaller than a radius of the circular virtual outer circumferential line along the entirety of the outer circumference of each of the second spur rollers.

2. The image recording apparatus according to claim 1, wherein as viewed in the width direction, the circular virtual outer circumferential line along the outer circumference of each of the first spur rollers does not intersect with the virtual straight line.

3. The image recording apparatus according to claim 1, wherein third spur rollers are provided at outer positions, of the first spur rollers and the second spur rollers, in the width direction respectively, and each of the third spur rollers is arranged at a position which is closer to the conveyance rollers than the first spur rollers in an orthogonal direction orthogonal to the conveyance direction and the width direction and which is downstream of the second spur rollers in the conveyance direction.

4. The image recording apparatus according to claim 3, wherein the first guide member has second guide surfaces provided at positions corresponding to ranges, in the width direction, in which the third spur rollers are arranged respectively, and configured to guide the sheet to the third spur rollers, and the second guide surfaces are arranged downstream of the first guide surface in the conveyance direction.

5. The image recording apparatus according to claim 4, wherein each of the second guide surfaces extends from upstream of the nip position to downstream of the nip position in the conveyance direction.

6. The image recording apparatus according to claim 4, wherein the first guide member is configured to support the first spur rollers, the second spur rollers, and the third spur rollers.

7. The image recording apparatus according to claim 1, wherein a position, which is on the circular virtual outer circumferential line along the outer circumference of each of the second spur rollers and at which a distance from a virtual plane is the shortest, is positioned downstream of the nip position in the conveyance direction, the virtual plane intersecting a rotational axis of the conveyance rollers and extending in the conveyance direction.

8. The image recording apparatus according to claim 1, further comprising a second guide member provided oppositely to the first guide member and having a third guide surface configured to guide the sheet to the nip position, wherein as viewed in the width direction, a virtual straight line along the third guide surface intersects with the first guide surface.

9. The image recording apparatus according to claim 8, wherein the second guide member is configured to abut against a roller shaft of the conveyance rollers, and the third guide surface is in a predetermined state with respect to the nip position.

10. The image recording apparatus according to claim 1, wherein the first guide member continuously extends in the width direction beyond the outermost first spur rollers in the width direction.

11. The image recording apparatus according to claim 1, wherein the first guide member is configured to support the first spur rollers and the second spur rollers.

* * * * *